United States Patent [19]

Isely

[11] 3,947,050

[45] Mar. 30, 1976

[54] ICE SKATE

[76] Inventor: Kenneth D. Isely, 1627 N. Holyoke, Wichita, Kans. 67208

[22] Filed: Oct. 21, 1974

[21] Appl. No.: 516,389

[52] U.S. Cl. ..... 280/11.18

[51] Int. Cl.[2] ..... A63L 1/32

[58] Field of Search..... 280/11.12, 11.18, 11.17, 280/11.16, 11.15, 11.14, 7.13, 11.1 R

[56] References Cited

UNITED STATES PATENTS

| | | | |
|---|---|---|---|
| 1,608,963 | 11/1926 | Smilden | 280/11.17 |
| 1,702,695 | 2/1929 | Hoult | 280/11.12 |
| 1,749,298 | 3/1930 | Orafsik | 280/11.18 |
| 2,150,964 | 3/1939 | Dornseif | 280/11.18 |

FOREIGN PATENTS OR APPLICATIONS

| | | | |
|---|---|---|---|
| 495,161 | 11/1938 | United Kingdom | 280/11.12 |

*Primary Examiner*—M. H. Wood, Jr.
*Assistant Examiner*—Milton L. Smith
*Attorney, Agent, or Firm*—Robert E. Breidenthal

[57] ABSTRACT

An ice skate of non-integral construction wherein a thin and resilient blade is flexed to mate with and along the underside of the skate body or base, with such parts being detachably secured by hook and worm gear means respectively at the front and rear ends of the blade. The hook means includes a toe pick of cruciform configuration.

13 Claims, 9 Drawing Figures

FIG. 1
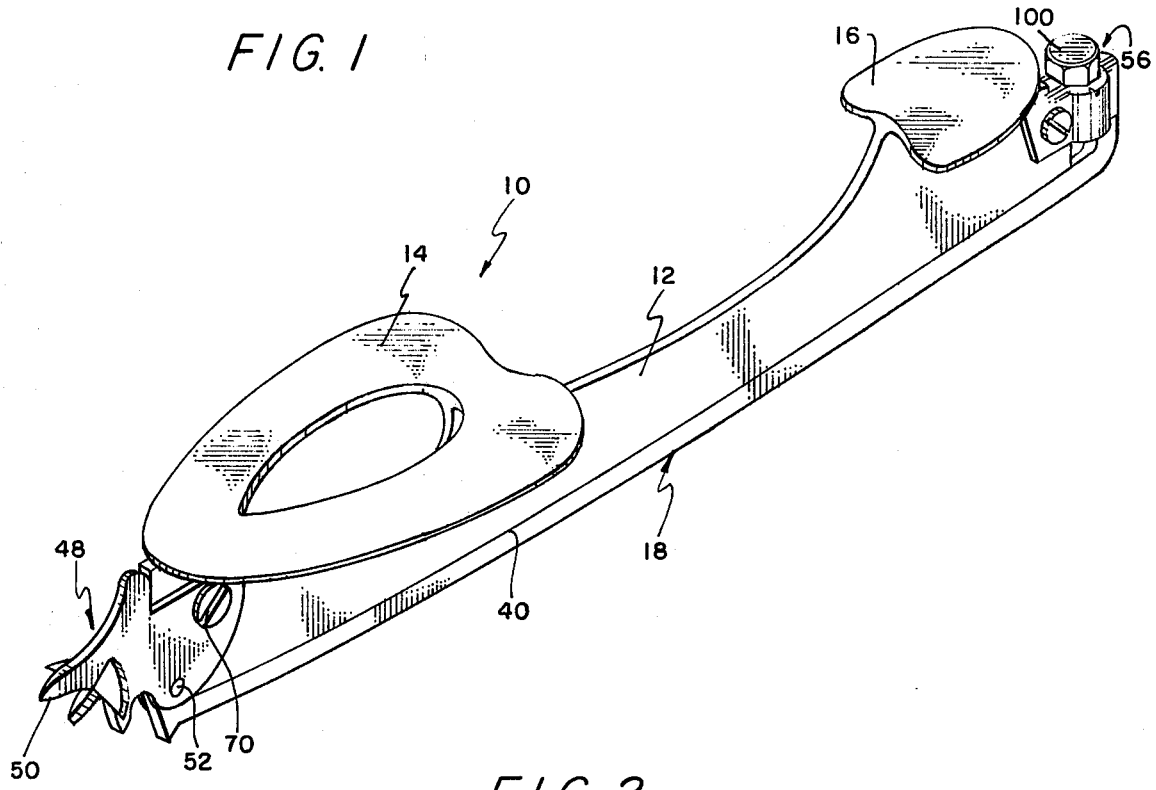
FIG. 2
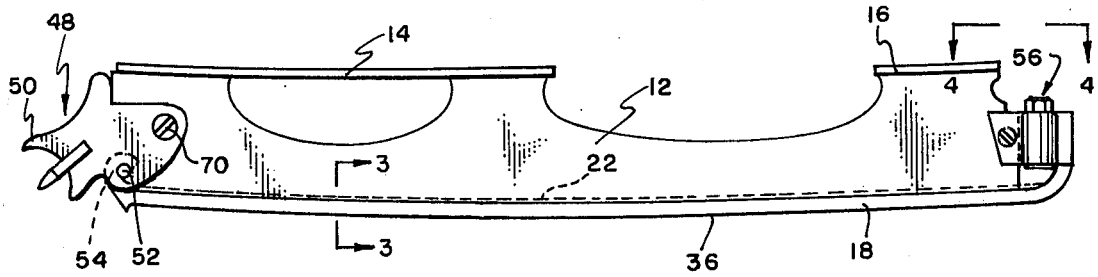
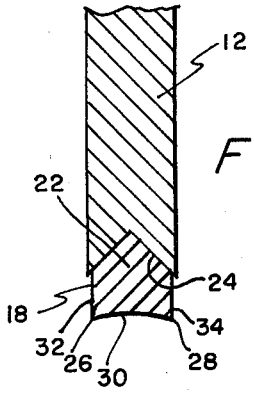
FIG. 3
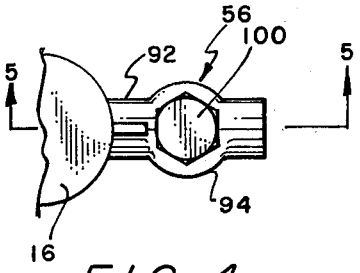
FIG. 4

ICE SKATE

The present invention pertains to new and useful improvements in ice skates and more particularly pertains to an ice skate having a toe pick of cruciform configuration and to an ice skate such that the lowermost marginal portion or blade is detachable.

The paramount objective of the present invention is to provide an ice skate such that the marginal portion of the skate body defining the skating or blade edge is readily detachable and replaceable, whereby the user can have a sharp pair of skate blades or skate blades of a different character (e.g., figure, free skating, etc.) in about the same time as normally required to change skate boots; this without the expense and inconvenience of having available an assortment of and spare skates.

Another important object of the present invention is to provide an ice skate compatible with the foregoing objective having a toe pick non-critical to use that is highly effective in accomplishing various figure skating means requiring vaulting off the ice while causing minimal damage to the ice.

Broadly, the present invention involves an ice skate of the type including an integral skate base inclusive of a vertical plate having an elongated lower edge of longitudinal convex curvature defining the blade edge of the skate, the improvement comprising such skate base being of non-integral construction with the lowermost marginal portion of such skate base defining the blade edge being separate from the remainder of the skate base, said blade edge defining marginal portion and said remainder being respectively hereinafter termed the blade and the skate body, said blade and said skate body having mating tongue and groove means interlocked along an intermediate portion of the skate's longitudinal extent, and means adjacent the opposite longitudinal extremities of the blade for detachably securing the blade to the skate body. Preferably, additionally the skate includes a toe pick of cruciform configuration that can be a part of the securing means.

The invention will be best appreciated in the light of the following description of a preferred embodiment of the invention, such description being given in conjunction with the accompanying drawings, wherein:

FIG. 1 is an isometric view of an ice skate according to the invention, the same being shown apart from the shoe or boot to which the same would be customarily attached;

FIG. 2 is a side elevation of the skate;

FIG. 3 is an enlarged sectional detail view taken on the plane of the section line 3—3 in FIG. 2;

FIG. 4 is an enlarged detail plan of the rear end portion of the skate taken from the plane of the line 4—4 in FIG. 2;

Figure 9:
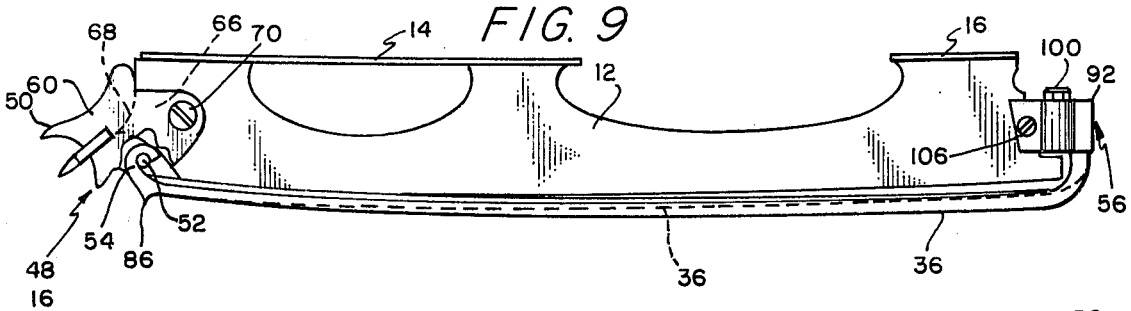
FIG. 9 is a side elevational view showing the blade in full lines prior to the worm gear being operated to secure the same, and showing in dashed line the position of the bottom edge of the blade after the worm gear has secured the same, with a portion being broken away to show the blade hook.

Referring now to the drawings wherein like numerals designate like parts throughout the various views, the reference numeral 10 designated the improved ice skate generally, it being understood that the same is to be connected in any suitable and conventional manner to a shoe or boot, now shown, of the user.

The ice skate 10 comprises a vertical generally planar skate body 12 having integral horizontal flanges 14 and 16 adjacent its forward and rear ends, respectively, for attachment to the undersides of the ball and heel portions of the user's boot or footwear, not shown.

The skate body 12 has detachably secured thereto a blade designated generally at 18. The skate body 12 together with the blade 18 attached thereto constitute the functional equivalent of the conventional integral skate base with its sharpened lower skating or blade edge.

The elongated blade 18 directly underlies the skate body 12 and the upper edge 20 of the blade 18 is of an inverted V-shape configuration 22 to mate with and be received in a complementary shaped groove 24 that extends longitudinally along the underside of the body 12 as best shown in FIG. 3. The mating of the V-shape or tongue 22 with the V-shape groove 24 constitutes tongue and groove means that not only prevents lateral displacement of the parts, but also tends to laterally guide the parts into proper lateral relationship as they are moved vertically toward each other.

Inasmuch as the body 12 does not have to be of a material of hard enough character to have a skating edge ground therein or be such as to be brazed to a hard material suitable for such use, the body 12 and the flanges 14 and 16 can be of relatively soft and lightweight material such as aluminum, and this is quite advantageous in that the body 12 and its flanges 14 and 16 can be readily fabricated by machining a T-shaped extrusion as will be readily understood by those conversant with manufacturing arts, such as tool and die makers, etc.

The blade 18 is made of material sufficiently hard as to hold an edge such as the edges 26 and 28 established by the hollow ground or concaved bottom surface 30 in relation to the flat parallel sides 32 and 34. Also the blade is made of resilient material. For such purpose the blade 18 can, for example, be made of materials such as A.I.S.I. 4130 or chromium-molybdenum steel.

The blade 18 has a vertical thickness such as to resiliently yield to a minor degree of flexing about a transverse axis. The arrangement is such that in response the lower edge 36 of the blade 18 will have a convex radius of curvature greater than that realized on assembly of the blade 18 with its body 12. Indeed, the repose radius of curvature viewed from above can be positive, infinite (which may be simply fabricated and/or sharpened), or even negative. The vertical thickness of the blase is therefore quite small and is preferably substantially uniform.

The lower and grooved edge 40 is longitudinally downwardly convex (a positive radius of curvature viewed from above) and serves to define the convex curvature of the lower edge 36 of the blade 18 when the skate 10 is assembled. The curvature of the grooved base edge 40 is greater than that of the blade, the arrangement being such that the ends of the blade 18 must be flexed upwardly relative to the center thereof on assembly of the skate 10 so that the blade 18 is resiliently self biased into its mating relationship to the base 12. Quite commonly the radius of the skating edge is about 7 feet and is referred to as the rocker in the industry.

Though the sides 32 and 34 of the blade 18 are shown flat and parallel, they can be hollow ground or concaved if desired to incorporate a common feature of conventional skates.

Proceeding now to the means for detachably securing the blade 18 to the body 12, there is provided at the forward end of the skate body 12 a combined means 48 for constituting a toe pick 50 and anchoring means or pin 52 for coacting with an upstanding hook 54 integral with the forward end of the blade 18. In addition to and coacting with such pick and hook means 48 at the forward end of the skate 10, there is provided a worm gear means 56 at the rear end of the body 12 for coacting with an upstanding rack 58 integral with the rear end of the blade 18.

The means 48 comprises a body or fitting 60 that is rearwardly bifurcated to include spaced side walls 62 and 64 between which is received a forward end portion 66 of the body 12. The leading edge of the base portion 66 seats against the inner wall 68 of the fitting 60 and the latter is fixed to the body 12 by conventional threaded fastening means such as indicated at 70.

At a position spaced below the base portion 66, the spaced walls 62 and 64 of the means 48 are joined by the pin frictionally driven into suitable openings 72 in such walls.

The body or fitting 60 and the pin 52 are preferably made of steel.

The toe pick 50 is of cruciform configuration and includes a forwardly projecting central tooth 76 disposed intermediate upper and lower teeth 78 and 80 that are all coplanar with the vertical body 12. The toe pick 50 additionally includes opposite and laterally extending teeth 82 and 84 disposed on opposite sides of the central tooth 76. The toe pick 50 is faced forwardly and downwardly and is more effective for vaulting in the performance of a variety of figure skating moves and is less critical in its use than is the case with customary toe picks. Furthermore, and largely due to the provision of the laterally extending teeth 82 and 84, the toe pick 50 does not damage and crater the ice surface as is the usual case. In this regard, the toe pick is the answer to a rink manager's dream.

The toe pick 50 is sufficiently well elevated to remain clear of the ice when the skater is making normal use of a tooth 86 disposed adjacent the forward end of the blade 18. It will be evident to those skilled in the art that the toe pick 50 can be entirely separate from the means for securing the blade 18; indeed either the toe pick 50 and/or the tooth 86 can be omitted if deemed necessary or expedient.

Referring now to the worm gear means 56, a worm gear 90 is disposed within a combined housing and mounting member for rotation about a vertical axis within a portion 94 of the latter that is internally conformable to the cylindrical surface defined by the exterior of the worm gear, the arrangement being such that the housing 92 constitutes a bearing for the worm gear 90. Vertical displacement of the worm gear 90 is prevented by a cap screw 96 threaded axially into and cemented into the worm gear 90 with the cap screw 96 rotatably extending through a suitable opening in the top wall 98 of the housing 92, the arrangement being such that the worm gear 90 can be readily turned by applying a wrench, not shown, to the head 100 of the cap screw 96. Cementation of the threaded connection of the cap screw 96 to the worm gear 90 precludes relative movement of such parts.

The side walls 102 of the housing 92 project forwardly of their journaled confinement of the worm gear 90 to receive therebetween a rear end portion 104 of the body 12 with the top wall 98 being seated atop such portion 104. The housing 92 and its contained gear 90 are fixed to the base by means of a suitable threaded fastening means 106. Such threaded fastening means 106 enables (if ever necessary) the replacement of the means 56, as does the fastening means 70 the combined means 48.

Figure 5:
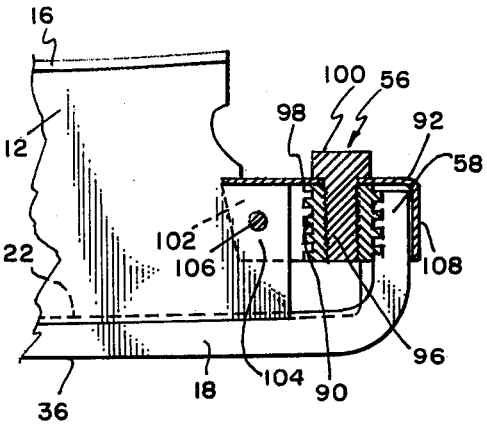
FIG. 5 is a vertical sectional detail taken on the plane of the section line 5—5 in FIG. 4.
Figure 6:
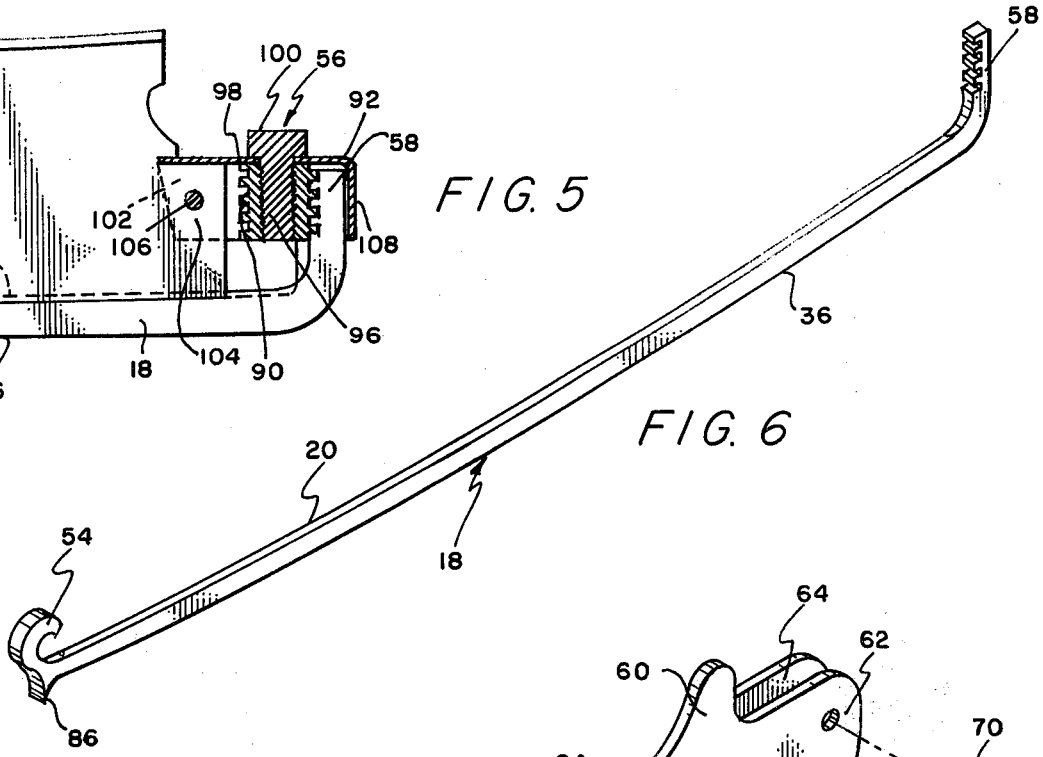
FIG. 6 is an isometric view of the blade.
Figure 7:
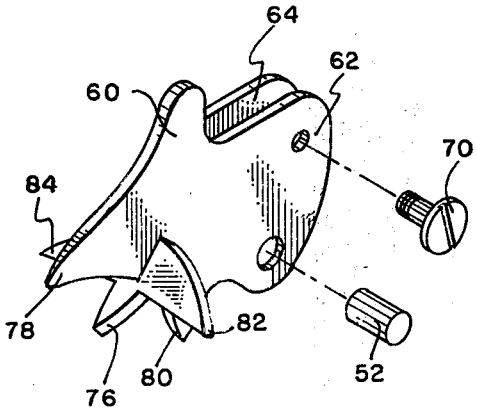
FIG. 7 is an enlarged isometric view of the toe pick and showing the hook pin and the toe pick fastening means in exploded relation thereto.
Figure 8:
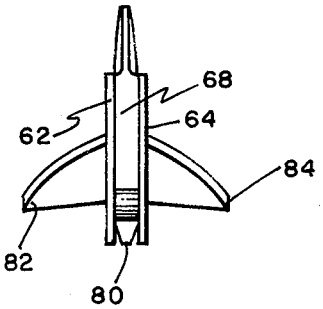
FIG. 8 is a rear view of the toe pick.

The housing 92 extends rearwardly of the gear 90 and is closed by a rear wall 108 with dimensions such as to accommodate therein the rack 58 when the latter is enmeshed with the gear 90 as shown in FIG. 5.

The means 56, like the means 48, is preferably made of steel.

The manner of assembly of the blade 18 with the body 12 will be readily understood. The hook 54 is inserted between the walls 62 and 64 and engaged over the pin 52 and the rear end of the blade 18 is raised upwardly with the tongue 22 thereof in the groove 24 of the body 12 and flexed upwardly to insert the upper end of the rack 58 into the housing 92 while turning the worm gear 90. This will serve to mesh the gear 90 and the rack 58 and continued manual turning of the gear 90 by use of a suitable tool, not shown, on the head 100 will forcibly draw the rack 58 and the blade 18 upwardly until the blade 18 is fully assembled with the body 12 and self biased strongly into the groove 24 in the body 12.

The effective gear ratio is such as to preclude the rack 58 from being withdrawn from the housing 92 except upon applying a turning torque to the gear 90 via the head 100. In other words, the driving means is unidirectional. The resiliency or bias of the blade 18 serves to maintain all parts of the blade securing means under load so as to prevent any free play of parts, and acts somewhat as a lock washer or stop nut with respect to the worm gear 90.

Detachment of an assembled blade 18 entails a mere reversal of the above stated assembly steps.

Attention is now directed to the appended claims.

I claim:

1. In an ice skate of the type including an integral skate base having an elongated lower edge of longitudinal convex curvature defining the blade edge of the skate, the improvement comprising the skate base being of nonintegral construction with the lowermost marginal portion of the skate base defining the blade edge of the base being separate from the remainder of the skate base, said portion and said remainder being respectively termed the blade and the skate body, said blade and said skate body having mating tongue and groove means interlocked along an intermediate portion of the longitudinal extent of the blade, and means adjacent the opposite longitudinal extremities of the blade for detachably securing the blade to the skate body, said blade being resilient and having a longitudinal radius of curvature in repose that is greater than that possessed by the same when secured to the skate body by the securing means, whereby the blade is resiliently self-biased toward the skate body when secured to the latter.

2. The combination of claim 1, wherein said securing means includes means for urging one of the longitudinal extremities of the blade toward the skate body.

3. The combination of claim 1, including a toe pick structure mounted on the skate body, said toe pick structure including a pair of teeth of about equal height that are disposed forwardly of the forward end of the blade and on opposite sides of a vertical plane defined by the blade.

4. The combination of claim 3, wherein the toe pick structure includes laterally spaced rearwardly extending wall portions disposed on opposite sides of the skate body and the forward end of the blade.

5. In an ice skate of the type including an integral skate base having an elongated lower edge of longitudinal convex curvature defining the blade edge of the skate, the improvement comprising the skate base being of non-integral construction with the lowermost marginal portion of the skate base defining the blade edge of the base being separate from the remainder of the skate base, said portion and said remainder being respectively termed the blade and the skate body, said blade and said skate body having mating tongue and groove means interlocked along an intermediate portion of the longitudinal extent of the blade, and means adjacent the opposite longitudinal extremities of the blade for detachably securing the blade to the skate body, wherein the blade is resilient, and wherein the skate body and the blade respectively have longitudinally extending lower and upper edges that are downwardly arcuate, with the radius of curvature of the upper edge of the blade being greater in repose than the radius of curvature of the lower edge of the skate body, the arrangement being such that the skate blade is held resiliently flexed against the skate body when secured to the latter, said securing means comprising a worm gear mounted on the skate body adjacent one longitudinal extremity of the blade and a coacting rack fixed to said extremity of the blade, the arrangement being such that actuation of the worm gear in one direction will act upon said one extremity of the blade to urge the latter toward the skate body.

6. The combination of claim 5, wherein said worm gear is provided with means adapted for detachable engagement by a manually operable tool thereby to enable a user selectively to secure and detach a blade to the skate body.

7. In an ice skate of the type including an integral skate base having an elongated lower edge of longitudinal convex curvature defining the blade edge of the skate, the improvement comprising the skate base being of non-integral construction with the lowermost marginal portion of the skate base defining the blade edge of the base being separate from the remainder of the skate base, said portion and said remainder being respectively termed the blade and the skate body, said blade and said skate body having mating tongue and groove means interlocked along an intermediate portion of the longitudinal extremities of the blade, and means adjacent the opposite longitudinal extremities of the blade for detachably securing the blade to the skate body, said securing means comprising a pin carried by the skate body adjacent the forward end of the blade, with said blade having an integral hook at its forward end detachably engaging said pin, and combined means for securing the pin to the skate body and for functioning as a toe pick, said combined means comprising a toe pick having a bifurcated rear portion defining a pair of spaced walls, said spaced walls being connected by said pin, said skate body being received between said walls with the latter being fixed to the skate body.

8. The combination of claim 7, wherein the toe pick is of cruciform configuration and includes a pair of oppositely and laterally extending teeth.

9. The combination of claim 7, wherein the toe pick includes a pair of laterally spaced teeth disposed on opposite sides of a vertical plane defined by the blade and at positions of substantially equal height above the height of the blade.

10. A detachable skate blade comprising an elongated resilient body having a lower edge adapted for engagement with an ice surface, said body having an integral upturned hook at its forward end and having an upwardly extending gear rack at its rear end, said body having an upper surface edge along the majority of its longitudinal extent that is of a transverse configuration of tongue and groove joint character, and said blade having a radius of curvature in repose as to its longitudinal dimension such that the ends thereof must be resiliently flexed upwardly to obtain a relatively reduced radius of curvature of about 7 feet.

11. An ice skate body adapted for detachable securance thereto of a skate blade, said ice skate body having an elongated lower edge having a downwardly facing surface of a transverse configuration of tongue and groove character, said body having a forwardly facing convex part adjacent its forward end adapted to be engaged by a blade hook, and worm gear means carried by the body adjacent its rear end adapted for engagement with a blade rack whereby a blade can be detachably secured to the body to extend along the underside of the body.

12. The combination of claim 11, including a pair of toe pick teeth carried at the forward end of the ice skate body, said teeth being laterally spaced and being substantially symmetrical to each other with respect to a vertical plane defined by said elongated lower edge.

13. In an ice skate of the class comprising an erect skate body provided with an elongated lower edge therealong for contacting an ice surface, the combination with said body of a laterally extending toe pick carried thereby at a position adjacent the forward end of said lower edge, said toe pick being comprised of at least two teeth and including a pair of teeth disposed on opposite sides of and substantially spaced from a vertical plane defined by said lower edge, with the teeth of said pair thereof being disposed about equal heights above the lower edge of the skate body, and said toe pick additionally including a pair of vertically spaced teeth disposed adjacent to the first mentioned pair of teeth and in said vertical plane to define with the first mentioned pair of teeth a cruciform configuration.

* * * * *